US009305679B2

(12) United States Patent
Abe et al.

(10) Patent No.: US 9,305,679 B2
(45) Date of Patent: Apr. 5, 2016

(54) VINYL CHLORIDE RESIN COMPOSITION, ELECTRIC WIRE AND CABLE

(71) Applicant: Hitachi Metals, Ltd., Tokyo (JP)

(72) Inventors: Daisuke Abe, Hitachi (JP); Ryutaro Kikuchi, Mito (JP)

(73) Assignee: Hitachi Metals, Ltd., Tokyo (JP)

( * ) Notice: Subject to any disclaimer, the term of this patent is extended or adjusted under 35 U.S.C. 154(b) by 0 days.

(21) Appl. No.: 14/508,794

(22) Filed: Oct. 7, 2014

(65) Prior Publication Data

US 2015/0096784 A1 Apr. 9, 2015

(30) Foreign Application Priority Data

Oct. 8, 2013 (JP) ..... 2013-211296

(51) Int. Cl.
*H01B 7/00* (2006.01)
*H01B 3/44* (2006.01)
*H01B 7/295* (2006.01)

(52) U.S. Cl.
CPC ..... *H01B 3/443* (2013.01); *H01B 3/445* (2013.01); *H01B 7/295* (2013.01); *Y10T 428/2933* (2015.01)

(58) Field of Classification Search
USPC ..... 174/110 R–110 E, 120 R, 121 R, 121 A, 174/122 R, 120 SR, 124 R; 524/490, 91, 474, 524/583, 240
See application file for complete search history.

(56) References Cited

U.S. PATENT DOCUMENTS 4,393,177 A * 7/1983 Ishii ..... C08F 226/06 525/175
2003/0094727 A1* 5/2003 Lange ..... B29C 47/0004 264/127
2009/0093577 A1* 4/2009 Berard ..... C08K 5/09 524/322
2009/0306296 A1* 12/2009 Nanba ..... C08K 5/18 525/200

FOREIGN PATENT DOCUMENTS

JP 57-149345 * 9/1982 ..... C08L 27/06
JP 7-149982 A 6/1995
JP 11-80474 A 3/1999
JP 11-199733 * 7/1999 ..... C08L 27/06

* cited by examiner

*Primary Examiner* — William H Mayo, III
(74) *Attorney, Agent, or Firm* — McGinn IP Law Group, PLLC

(57) ABSTRACT

A vinyl chloride resin composition includes 55 to 70 parts by mass of a plasticizer, 20 to 65 parts by mass of a metal hydrate and 0.3 to 3 parts by mass of a polytetrafluoroethylene per 100 parts by mass of a vinyl chloride resin. The polytetrafluoroethylene includes a fibril-forming polytetrafluoroethylene and a non-fibril-forming polytetrafluoroethylene.

9 Claims, 5 Drawing Sheets

2 STRANDS CONSTITUTING SHIELDING LAYER
11 CONDUCTOR 12 INSULATION

2 STRANDS CONSTITUTING SHIELDING LAYER
11 CONDUCTOR 12 INSULATION

VINYL CHLORIDE RESIN COMPOSITION, ELECTRIC WIRE AND CABLE

The present application is based on Japanese patent application No. 2013-211296 filed on Oct. 8, 2013, the entire contents of which are incorporated herein by reference.

BACKGROUND OF THE INVENTION

1. Field of the Invention

The invention relates to a vinyl chloride resin composition with a flame retardancy, and an electric wire and a cable each covered by the resin composition.

2. Description of the Related Art

Wires/cables used inside electric/electronic devices or used for wiring between devices are required to be highly flame retardant (e.g., required to pass the VW-1 test of UL standard). Some cables have a structure in which a wire core or two or more wire cores each formed by covering a conductor with an insulation are covered with a metal shielding layer and a sheath (see FIGS. 1 and 2) and some of such cables or the like are also required to have high signal transmission characteristics. Insulation materials for such cables are desired to have a low permittivity and flammable resin compositions, such as polyethylene, which do not include an inorganic flame retardant are therefore used. Sheath materials of such cables are required to be more highly flame retardant in order to provide enough flame retardancy.

On the other hand, the wires/cables used inside electric/electronic devices or used for wiring between devices are often required to have flexibility so as to be flexibly wired and handled during use of devices. Flexibility of cable is greatly affected by flexibility of sheath material.

As such, for the wires/cables used inside electric/electronic devices or used for wiring between devices, the sheath material (or the insulation material for insulated wires) are required to have both high flame retardancy and flexibility.

Polyvinyl chloride resin compositions could be used as materials which satisfy such requirements. In general, polyvinyl chloride resin compositions are often used as a covering material of wires/cables because of having a favorable balance of mechanical characteristics, heat resistance, cold resistance, electrical insulation properties, flame retardancy, processability and economic efficiency which can be adjusted by changing a compounding ratio of plasticizer, stabilizer and flame retardant, etc. Flexibility of the polyvinyl chloride resin compositions is enhanced by increasing a compounding ratio of plasticizer, but flame retardancy of the composition decreases with increasing the compounding ratio of plasticizer since it is a flammable liquid. Therefore, polyvinyl chloride resin compositions including antimony trioxide as a flame retardant, alone or in conjunction with other flame retardants, have been used for covering materials of wires/cables (see JP-A-H07-149982). Compositions including a large amount of antimony trioxide are used especially when both high flame retardancy and flexibility are required as described above.

However, use of antimony compounds tends to be cut down in recent years due to concerns about adverse effects on environment or human body. For example, antimony trioxide causes weak irritation on skin or mucous membrane and is thus designated as a dangerous drug. Furthermore, the antimony compound as a mineral resource has an increasing risk of unstable supply and an increase in cost because mines are unevenly distributed and the supply-demand balance tends to be tight.

In such circumstance, flame-retardant covering materials not including an antimony compound are demanded. For example, a method of enhancing flame retardancy by adding zinc hydroxy stannate and zinc borate to a vinyl chloride-based polymer is known (see JP-A-H11-080474).

SUMMARY OF THE INVENTION

When the method disclosed in JP-A-H11-080474 is employed for a sheath material of the above-mentioned cables which are required to have both high flame retardancy and flexibility, no sufficient flame retardancy is obtained and, furthermore, the heat resistance decreases due to an increase in the total amount of zinc.

It is an object of the invention to provide a vinyl chloride resin composition that is free from any antimony compound and has a sufficient flame retardancy and flexibility and is also excellent in heat resistance, as well as an environmentally-friendly wire and cable using the vinyl chloride resin composition.

(1) According to one embodiment of the invention, a vinyl chloride resin composition comprises:

55 to 70 parts by mass of a plasticizer, 20 to 65 parts by mass of a metal hydrate and 0.3 to 3 parts by mass of a polytetrafluoroethylene per 100 parts by mass of a vinyl chloride resin, wherein the polytetrafluoroethylene includes a fibril-forming polytetrafluoroethylene and a non-fibril-forming polytetrafluoroethylene.

In the above embodiment (1) of the invention, the following modifications and changes can be made.

(i) Particles of the polytetrafluoroethylene have a multilayer structure comprising a core formed of a fibril-forming high-molecular-weight polytetrafluoroethylene and an outermost shell formed of a non-fibril-forming low-molecular-weight polytetrafluoroethylene.

(ii) The polytetrafluoroethylene is dispersed in a fibrillated form.

(iii) The metal hydrate entirely or partially comprises either hydrotalcite, aluminum hydroxide or a mixture thereof (iv) The plasticizer entirely or partially comprises either tri-2-ethylhexyl trimellitate, tri-n-octyl trimellitate or a mixture thereof.

(2) According to another embodiment of the invention, an electric wire comprises the vinyl chloride resin composition according to the above embodiment (1) provided to cover the electric wire.

(3) According to another embodiment of the invention, a cable comprises the vinyl chloride resin composition according to the above embodiment (1) provided as a sheath to cover the cable.

In the above embodiment (3) of the invention, the following modifications and changes can be made.

(v) The cable further comprises a cable core comprising a wire core or two or more wire cores twisted together, the wire cores being each formed by covering a conductor with a flammable resin composition not including a flame retardant.

(vi) The cable further comprises a metal shielding layer provided around the cable core.

Effects of the Inventions

According to one embodiment of the invention, a vinyl chloride resin composition can be provided that is free from any antimony compound and has a sufficient flame retardancy and flexibility and is also excellent in heat resistance, as well as an environmentally-friendly wire and cable using the vinyl chloride resin composition.

BRIEF DESCRIPTION OF THE DRAWINGS

Next, the present invention will be explained in more detail in conjunction with appended drawings, wherein.

DETAILED DESCRIPTION OF THE PREFERRED EMBODIMENTS

Figure 1:
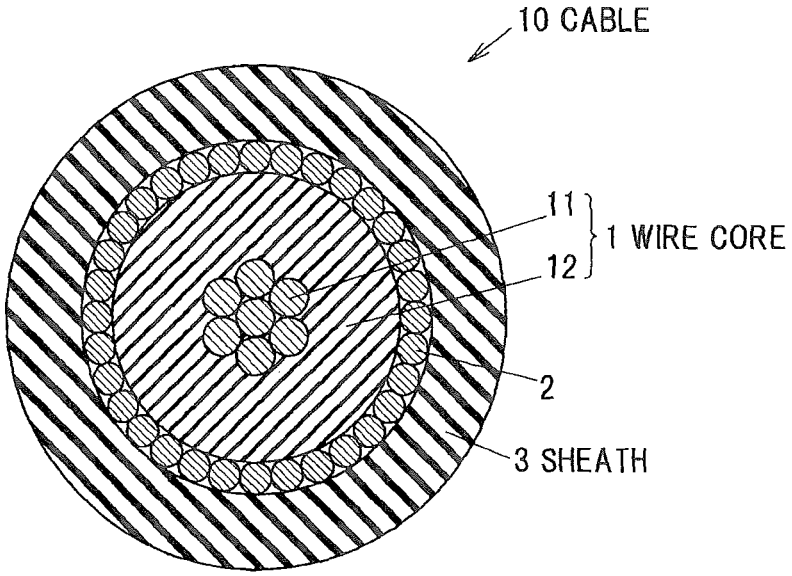
FIG. 1 is a cross sectional view showing a cable in a first embodiment of the present invention.

Embodiments of a vinyl chloride resin composition, an electric wire and a cable of the invention will be specifically described below.

Vinyl Chloride Resin Composition

A vinyl chloride resin composition in the embodiment of the invention includes 55 to 70 parts by mass of plasticizer, 20 to 65 parts by mass of metal hydrate and 0.3 to 3 parts by mass of polytetrafluoroethylene (PTFE) particles per 100 parts by mass of vinyl chloride resin.

To flame-retard a cable using a flammable resin composition not including flame retardants for covering each wire of cable core, the present inventors focused on an effect of an endothermic reaction of a sheath material during combustion to reduce a combustion cycle of the sheath material per se and an effect of formation of strong residue in the sheath material during combustion to hinder propagation of heat and oxygen to the cable core. And, as a result of examining a vinyl chloride resin composition used for the sheath material, it was found that it is effective when these two effects are present at the same time.

Vinyl Chloride Resin

The vinyl chloride resin in the embodiment of the invention is, e.g., a homopolymer of vinyl chloride, i.e., a polyvinyl chloride resin, a copolymer of vinyl chloride with another copolymerizable monomer, or a mixture thereof. A polyvinyl chloride resin with an average degree of polymerization of 1000 to 2500 is usually used. The other copolymerizable monomer only needs to be a monomer which can be copolymerized with vinyl chloride and it is possible to use, e.g., one or more selected from ethylene, vinyl acetate, vinylidene chloride, acrylic acid, acrylic ester, methacrylic acid and methacrylate ester, etc.

Metal Hydrate

The vinyl chloride resin composition in the present embodiment includes a predetermined amount of metal hydrate. This causes an endothermic reaction when the vinyl chloride resin composition is burnt. The metal hydrate is dehydrated and decomposed in a decomposition temperature range of the vinyl chloride resin. This is the endothermic reaction and produces an effect of suppressing expansion of the combustion of the resin composition. In addition, adding an inorganic material to the resin composition is considered to be effective to increase volume of residues formed during combustion (visually identifiable) and to increase an effect of insulating the cable core from heat and oxygen.

Examples of the metal hydrate include hydrotalcite, aluminum hydroxide, magnesium hydroxide and calcium hydroxide, etc. It is exemplary that the metal hydrate be entirely or partially hydrotalcite or aluminum hydroxide or a mixture thereof since it contributes to heat resistance by capturing hydrogen chloride generated during molding or generated by thermal load and also has less impact on acceleration of deterioration of the polyvinyl chloride resin generally caused by metal elements.

The added amount of the metal hydrate is 20 to 65 parts by mass, exemplarily 30 to 50 parts by mass, more exemplarily 40 to 50 parts by mass per 100 parts by mass of the vinyl chloride resin. Flame retardancy is not enough when less than 20 parts by mass. On the other hand, when more than 65 parts by mass, an effect of improving flame retardancy is saturated and flexibility is impaired.

Polytetrafluoroethylene

The vinyl chloride resin composition in the present embodiment includes a predetermined amount of polytetrafluoroethylene (hereinafter, referred to as "PTFE"). This PTFE includes a fibril-forming PTFE and a non-fibril-forming PTFE. This causes strong residue to be formed when the vinyl chloride resin composition is burnt. A ratio of the fibril-forming PTFE to the non-fibril-forming PTFE in the vinyl chloride resin composition is exemplarily the former to the latter=95:5 to 30:70, more exemplarily 90:10 to 50:50.

The PTFE receives a shearing force at the time of melt-kneading the resin composition and is thus dispersed in the fibrillated form in the resin composition. This dispersed state is maintained even after being molded as a covering material of wire/cable. Furthermore, since PTFE is a highly flame-retardant substance, the state of being dispersed in a fibril form is still maintained even at an initial stage of solid-state combustion in which the resin composition is softened, thermally decomposed and fluidized. Thus, the flow of the resin composition is suppressed. Since this flow is considered to be a cause of expanding a burning section during combustion of wire/cable and inhibiting fixation of combustion residues, it is considered that the suppression of the flow contributes especially to formation of strong combustion residue. Particles of the PTFE are exemplarily fine particles since dispersibility is better. The fine particle size of the PTFE is exemplarily 0.05 to 1 μm, more exemplarily 0.1 to 0.5 μm, further exemplarily 0.15 to 0.4 μm.

The PTFE is not specifically limited as long as both the fibril-forming PTFE and the non-fibril-forming PTFE are used, but it is exemplary that the particles of the PTFE have a multilayer structure including a core formed of a fibril-forming high-molecular-weight polytetrafluoroethylene and an outermost shell formed of a non-fibril-forming low-molecular-weight polytetrafluoroethylene. This particle structure prevents a decrease in dispersibility caused by entanglement of PTFEs and resulting deterioration of appearance after molding the resin composition. The high-molecular-weight polytetrafluoroethylene is not specifically limited as long as it has fibril-forming properties, but the molecular weight thereof is exemplarily 1,000,000 to 9,000,000, more exemplarily 2,000,000 to 8,000,000. Meanwhile, the low-molecular-weight polytetrafluoroethylene is not specifically limited as long as it has non-fibril-forming properties, but the molecular weight thereof is exemplarily less than 1,000,000, more exemplarily 10,000 to 800,000.

The added amount of the PTFE is 0.3 to 3 parts by mass, exemplarily 0.5 to 2 parts by mass, per 100 parts by mass of the vinyl chloride resin. Flame retardancy is not sufficient when less than 0.3 parts by mass. On the other hand, appearance after molding is poor when more than 3 parts by mass.

Plasticizer

The vinyl chloride resin composition in the present embodiment includes a predetermined amount of plasticizer. As the plasticizer, it is possible to use a trimellitate-based plasticizer, a pyromellitic acid ester-based plasticizer, a polyester-based plasticizer, a phthalate ester-based plasticizer, an epoxy-based plasticizer and a dicarboxylate-based plasticizer. In order to impart favorable heat resistance, it is exemplary that the plasticizer be entirely or partially a trimellitate-based plasticizer, specifically, either tri-2-ethylhexyl trimellitate (TOTM), tri-n-octyl trimellitate (TnOTM) or a mixture thereof.

The added amount of the plasticizer is 55 to 70 parts by mass, exemplarily 60 to 70 parts by mass, per 100 parts by mass of the vinyl chloride resin. Flexibility is not sufficient when less than 55 parts by mass. On the other hand, when more than 70 parts by mass, the amount of flammable component in the resin composition is too large and the flame retardant effect of the invention is thus not exerted.

Other Additives

The vinyl chloride resin composition in the present embodiment can usually include a stabilizer, a filler and a colorant, etc., in addition to the above-mentioned components. It is exemplary to include, e.g., the stabilizer in an amount of 2 to 10 parts by mass and the total of the filler and the metal hydrate in an amount of 20 to 80 parts by mass per 100 parts by mass of the vinyl chloride resin.

The stabilizer may be a commercially-available composite stabilizer such as calcium-zinc based or barium-zinc based stabilizer. Lead-including stabilizers of which adverse effects on environment or human body are identified are not preferable. Also, it is possible to add an appropriate amount of β-diketones having effects of substituting unstable chlorine or capturing metal chloride, polyols acting to capture mainly metal chloride, perchlorates acting to eliminate double bonds, zeolites or fatty acid metal salts acting to capture hydrogen chloride, phenolic antioxidants acting to deactivate radicals, amine-based or thioether-based antioxidants acting to decompose peroxides or to capture radicals, and ultraviolet absorbers, etc.

Examples of the filler include calcium carbonate, clay, talc and silica, etc.

Manufacturing Method

A method of manufacturing the vinyl chloride resin composition in the present embodiment is not specifically limited and any manufacturing methods can be employed as long as the resin composition is kneaded so that each component is substantially uniformly dispersed and mixed. It is possible to obtain the resin composition by kneading using, e.g., a Banbury mixer, a Ko-kneader, a co-rotating twin-screw extruder, a counter-rotating twin-screw extruder, a roll kneader or a batch kneader, etc.

Intended Use

The vinyl chloride resin composition in the present embodiment does not include antimony compounds, has sufficient flame retardancy and flexibility, is excellent in heat resistance, and thus can be suitably used for insulations of electric wires (insulated wires) or sheaths of cables.

Electric Wire/Cable

FIG. 1 is a cross sectional view showing a cable in the first embodiment of the invention. A cable 10 has a structure in which a wire core 1 formed by covering a conductor 11 with an insulation 12 is provided as a cable core, a shielding layer formed of metal strands 2 is provided therearound and a sheath 3 is provided to cover the periphery thereof. The insulation 12 is formed of, e.g., a flammable resin composition not including a flame retardant. The sheath 3 is formed by extrusion-molding the vinyl chloride resin composition in the present embodiment using a coating extruder.

Figure 2:
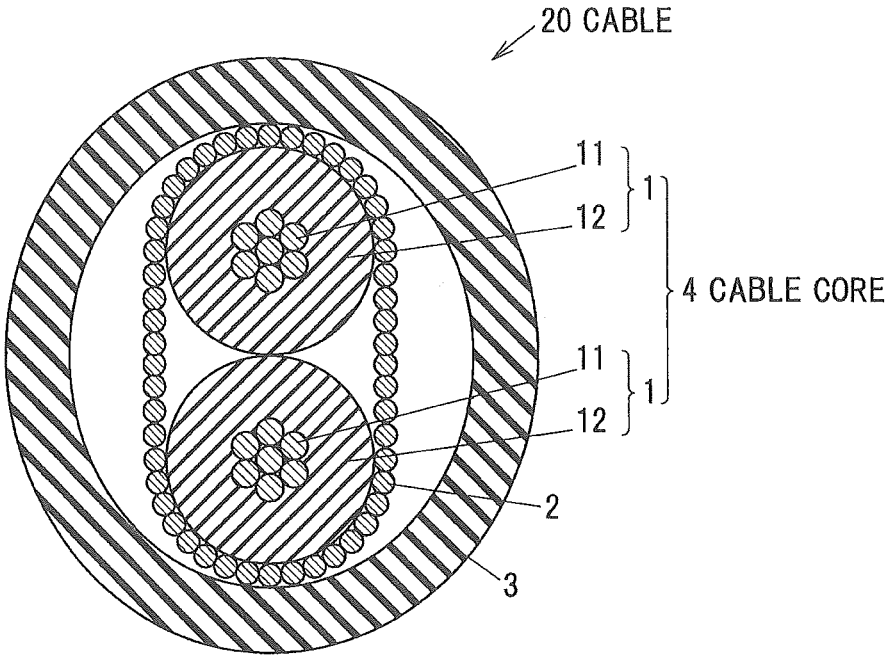
FIG. 2 is a cross sectional view showing a cable in a second embodiment of the invention.

FIG. 2 is a cross sectional view showing a cable in the second embodiment of the invention. A cable 20 has a structure in which (two) wire cores 1 each formed by covering the conductor 11 with the insulation 12 are twisted to form a cable core 4, the shielding layer formed of the metal strands 2 is provided around the cable core 4 and the sheath 3 is provided to cover the periphery thereof.

Figure 3:
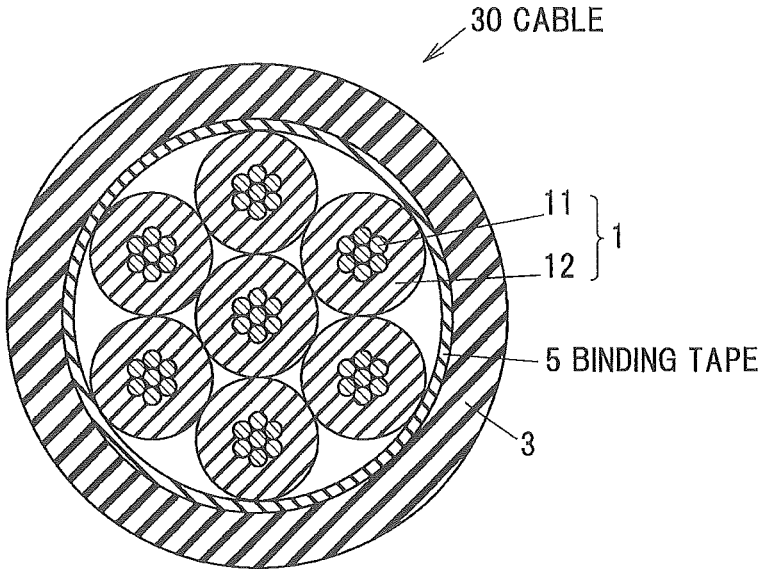
FIG. 3 is a cross sectional view showing a cable in a third embodiment of the invention.

FIG. 3 is a cross sectional view showing a cable in the third embodiment of the invention. A cable 30 has a structure in which multiple wire cores 1 each formed by covering the conductor 11 with the insulation 12 are twisted to form a cable core, a binding tape 5 is wound around the cable core and the sheath 3 is provided to cover the periphery thereof.

Figure 4:
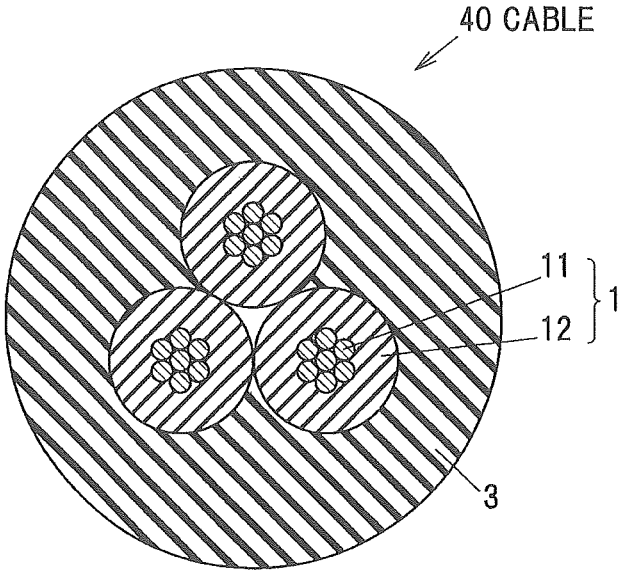
FIG. 4 is a cross sectional view showing a cable in a fourth embodiment of the invention.

FIG. 4 is a cross sectional view showing a cable in the fourth embodiment of the invention. A cable 40 has a structure in which (three) wire cores 1 each formed by covering the conductor 11 with the insulation 12 are twisted to form a cable core and the sheath 3 is provided to directly cover the periphery thereof.

Figure 5:
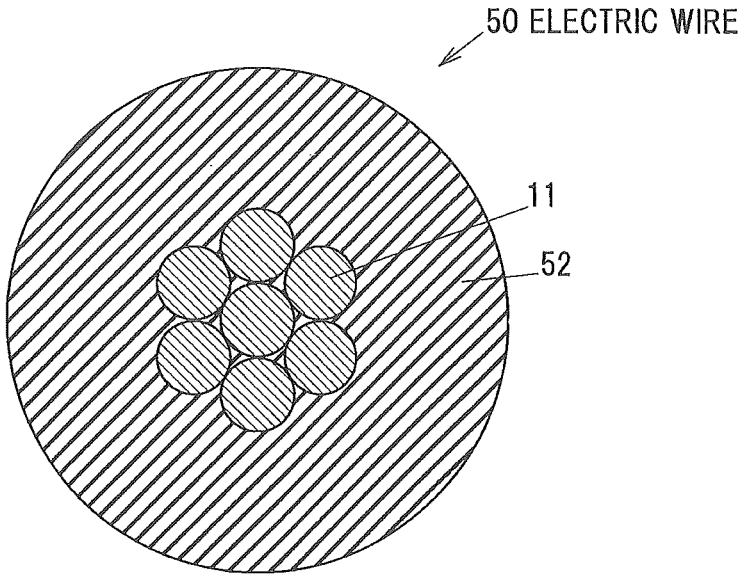
FIG. 5 is a cross sectional view showing an electric wire in an embodiment of the invention.

FIG. 5 is a cross sectional view showing an electric wire in the embodiment of the invention. An electric wire 50 has a structure in which an insulation 52 is provided to cover the conductor 11. The insulation 52 is formed by extrusion-molding the vinyl chloride resin composition in the present embodiment using a coating extruder.

The vinyl chloride resin composition of the invention is applicable not only to the cables having structures of the first and second embodiments and required to have high transmission characteristics but also to other cables (the third and fourth embodiments) as well as the electric wire (the above-mentioned embodiment), and allows wires/cables having high flame retardancy and flexibility to be provided.

The vinyl chloride resin composition of the invention is applicable as a sheath material also in case that the insulation 12 in the first to fourth embodiments is formed of a flame-retardant resin composition. In addition, the vinyl chloride resin composition of the invention can be used not only as a sheath material of such cables but also as an insulation material of each wire core.

EXAMPLES

The cables of the invention will be described below in reference to Examples. It should be noted that the following examples are not intended to limit the invention in any way.

Examples 1 to 4 and Comparative Examples 1 to 7

(1) Kneading of Vinyl Chloride Resin Composition

Components shown in Table 1 except plasticizer were introduced into a Henschel mixer (a high-speed stirring mixer), mixed at a low speed for about 10 seconds, then mixed at a high speed while continuously adding the plasticizer little by little, and the resulting mixture was dried up by increasing the temperature of the resin to 110° C. After kneading for 5 minutes by a mixing roll which was set at 160° C., this mixture was formed into a sheet.

(2) Making Sheets for Evaluation

The vinyl chloride resin composition sheet was pre-heated at 170° C. for 3 minutes by a heat press, the temperature was then kept for 2 minutes while applying a pressure of 100 kgfcm$^2$ and was cooled to room temperature in 5 minutes, thereby making a 1 mm-thick evaluation sample sheet.

(3) Making Cables for Evaluation

Two types of evaluation sample cables respectively having the structures shown in FIGS. 1 and 2 were made. Wire cores used for both types of cables were obtained as follows: a tin-plated copper wire having an outer diameter of 0.38 mm (seven twisted strands each having an outer diameter of 0.127 mm) was used as a conductor, a 0.25 mm-thick insulation formed of foamed low-density polyethylene not including flame retardant was provided to cover the periphery of the conductor and was then crosslinked by exposure to electron beam. A cable core of one type of the cable is constructed from one wire core as shown in FIG. 1, and a wire core of another type of cable is constructed from two twisted wire cores as shown in FIG. 2. Tin-plated soft conductive wires having an outer diameter of 0.1 mm were wound around each cable core to form a shielding layer and the vinyl chloride resin composition of 0.25 mm in thickness was provided as a sheath to cover the periphery thereof. The sheath was provided using a vinyl chloride resin composition sheet cut into 5 mm-square pellets and a 40-mm extruder set to a cylinder top temperature of 190° C. and a head temperature of 195° C.

Following various evaluation tests were conducted. Table 1 shows the evaluation results.

Evaluation Tests (1) Evaluation of Flexibility

As a result of examining a method of quantitatively evaluating flexibility of sheath which affects the wiring flexibility of cable, it was found that a value of stress at the elongation percentage of as small as not more than 30% in a tensile test of sheath material well corresponds to the wiring flexibility of cable. A stress at an elongation percentage of 20% in the tensile test (20% modulus) was used as an indicator of flexibility, and not more than 6.9 MPa was regarded as acceptable based on comparison with the wiring flexibility of cable. Measurement was carried out as follows: a strip of sample having a width of 6 mm and a length of 100 mm was punched out from each 1 mm-thick evaluation sample sheet so that the length direction coincides with a feeding direction of the material during roll kneading, the respective strips were attached to sample holders of a tensile test machine which were set at intervals of 75 mm and were then subjected to the tensile test at a rate of 500 mm/min, (2) Evaluations of Tensile Characteristics and Heat Resistance A dumbbell test piece was punched out from each 1 mm-thick evaluation sample sheet and was subjected to the tensile test before and after heating in accordance with JIS K 6723. Heating temperature and heating time were determined to be 136° C. and 168 hours by taking into consideration the UL standard requirement for 105° C. rated wire and cable, and tensile strength retention of not less than 70% and elongation retention of not less than 70% were regarded as acceptable. As for the tensile characteristics before heating, tensile strength of not less than 13.8 MPa and elongation of not less than 150% were regarded as acceptable.

(3) Evaluation of Extrusion Processability

The above-mentioned sheath was continuously extruded at a linear speed of 400 m/min for not less than 12 hours. The sheath was regarded as acceptable when yellowing (discoloration) did not occur and an outer diameter was never out of the required tolerance.

(4) Evaluation of Flame Retardant

The obtained cables were subjected to the VW-1 test of UL standard. It was evaluated as acceptable when 10 out of 10 cables satisfied the standard.

TABLE 1

| | | | Examples | | | | Comparative Examples | | | | | | |
|---|---|---|---|---|---|---|---|---|---|---|---|---|---|
| | | | 1 | 2 | 3 | 4 | 1 | 2 | 3 | 4 | 5 | 6 | 7 |
| Composition | Polyvinyl chloride resin | | 100 | 100 | 100 | 100 | 100 | 100 | 100 | 100 | 100 | 100 | 100 |
| | TOTM | | 55 | 70 | | | 54 | 72 | | | 60 | 70 | 60 |
| | TnOTM | | | | 62 | 65 | | | 62 | 65 | | | |
| | Ca—Zn based stabilizer | | 4 | 4 | 4 | 4 | 4 | 4 | 4 | 4 | 4 | 4 | 4 |
| | Hydrotalcite | | 10 | 20 | 5 | 20 | 10 | 20 | 5 | 30 | 10 | 20 | 10 |
| | Aluminum hydroxide | | 30 | 30 | 15 | 45 | 30 | 30 | 10 | 45 | 30 | 30 | 30 |
| | PTFE | | 0.3 | 3 | 2 | 0.5 | 0.3 | 3 | 2 | 0.5 | 0.1 | 5 | |
| | Zinc borate | | | | | | | | | | | | 10 |
| | Baked clay | | 10 | 5 | 5 | 5 | 10 | 5 | 5 | 5 | 10 | 5 | 10 |
| | Heavy calcium carbonate | | | 15 | | | | 15 | | | | 15 | |
| Sheet | Flexibility | 20% modulus (MPa) | 6.9 | 4.6 | 5.1 | 6.4 | 7.6 | 4.1 | 4.8 | 7.3 | 6.5 | 4.7 | 7.1 |
| | Tensile characteristics | Tensile strength (MPa) | 17.2 | 17.6 | 18.9 | 17.5 | 17.8 | 17.4 | 19.4 | 16.2 | 17.3 | 17.5 | 16.1 |
| | | Elongation (%) | 330 | 350 | 330 | 310 | 290 | 360 | 330 | 270 | 330 | 360 | 320 |
| | Heat resistance | Tensile strength retention (%) | 101 | 96 | 95 | 102 | 100 | 95 | 97 | 108 | 99 | 95 | 110 |
| | | Elongation retention (%) | 96 | 89 | 92 | 81 | 94 | 89 | 96 | 76 | 97 | 87 | 62 |
| Cable | Cable structure | | FIG. 1 | FIG. 1 | FIG. 2 | FIG. 2 | FIG. 1 | FIG. 1 | FIG. 2 | FIG. 2 | FIG. 1 | FIG. 1 | FIG. 1 |
| | Extrusion processability | | ○ | ○ | ○ | ○ | ○ | ○ | ○ | ○ | ○ | X | ○ |
| | Flame retardancy | | ○ | ○ | ○ | ○ | ○ | X | X | ○ | X | ○ | X |

The materials used for compositions in Table 1 are as follows:

Polyvinyl chloride resin: TH-1300 manufactured by Taiyo Vinyl Corporation

TOTM (tri-2-ethylhexyl trimellitate): TREVIEX T-08 manufactured by Kao Corporation TnOTM (tri-n-octyl trimellitate): TRIMEX N-08 manufactured by Kao Corporation Ca—Zn based stabilizer: OW-3152 manufactured by Sakai Chemical Industry Co., Ltd.

Hydrotalcite: HT-1 manufactured by Sakai Chemical Industry Co., Ltd.

Aluminum hydroxide: HIGILITE H-42M manufactured by Showa Denko K. K.

PTFE (fine particle powder): FA-500H manufactured by Daikin Industries, Ltd.

Zinc borate: SZB-500 manufactured by Sakai Chemical Industry Co., Ltd.

Baked clay: Satintone SP-33 manufactured by BASF

Heavy calcium carbonate: Softon 1200 manufactured by Bihoku Funka Kogyo Co., Ltd.

In Examples 1 to 4, each vinyl chloride resin composition as a sheath material was prepared to include 55 to 70 parts by mass of plasticizer (TOTM, TnOTM), 20 to 65 parts by mass of metal hydrate (total of hydrotalcite and aluminum hydroxide) and 0.3 to 3 parts by mass of fine particles composed of a core formed of a fibril-forming PTFE and a shell formed of a non-fibril-forming PTFE per 100 parts by mass of polyvinyl chloride resin. Results of flexibility, heat resistance, extrusion processability and flame retardancy were satisfactory in all of Examples 1 to 4.

Flexibility was insufficient in Comparative Example 1 in which the added amount of plasticizer was less than 55 parts by mass, while flame retardancy was insufficient in Comparative Example 2 using more than 70 parts by mass of plasticizer.

Flame retardancy was insufficient in Comparative Example 3 in which the added amount of metal hydrate was less than 20 parts by mass, while flexibility was insufficient in Comparative Example 4 using more than 65 parts by mass of metal hydrate.

Flame retardancy was insufficient in Comparative Example 5 in which the added amount of the fine particles composed of a core formed of a fibril-forming high-molecular-weight PTFE and a shell formed of a non-fibril-forming low-molecular-weight PTFE was less than 0.3 parts by mass, while appearance after molding was poor and extrusion processability was thus insufficient in Comparative Example 6 in which the added amount of the fine particles was more than 3 parts by mass.

In Comparative Example 7 in which progress of formation of combustion residues in the sheath was attempted by adding a large amount of zinc borate, flame retardancy was insufficient and heat resistance was also insufficient due to zinc burn.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A vinyl chloride resin composition, comprising:

55 to 70 parts by mass of a plasticizer, 20 to 65 parts by mass of a metal hydrate and 0.3 to 3 parts by mass of a polytetrafluoroethylene per 100 parts by mass of a vinyl chloride resin, wherein the polytetrafluoroethylene includes a fibril-forming polytetrafluoroethylene and a non-fibril-forming polytetrafluoroethylene.

2. The vinyl chloride resin composition according to claim 1, wherein particles of the polytetrafluoroethylene have a multilayer structure comprising a core formed of a fibril-forming high-molecular-weight polytetrafluoroethylene and an outermost shell formed of a non-fibril-forming low-molecular-weight polytetrafluoroethylene.

3. The vinyl chloride resin composition according to claim 1, wherein the polytetrafluoroethylene is dispersed in a fibrillated form.

4. The vinyl chloride resin composition according to claim 1, wherein the metal hydrate entirely or partially comprises either hydrotalcite, aluminum hydroxide or a mixture thereof.

5. The vinyl chloride resin composition according to claim 1, wherein the plasticizer entirely or partially comprises either tri-2-ethylhexyl trimellitate, tri-n-octyl trimellitate or a mixture thereof.

6. An electric wire, comprising:

the vinyl chloride resin composition according to claim 1 provided to cover the electric wire.

7. A cable comprising:

the vinyl chloride resin composition according to claim 1 provided as a sheath to cover the cable.

8. The cable according to claim 7, further comprising a cable core comprising a wire core or two or more wire cores twisted together, the wire cores being each formed by covering a conductor with a flammable resin composition not including a flame retardant.

9. The cable according to claim 8, further comprising a metal shielding layer provided around the cable core.

* * * * *